US011511974B1

(12) United States Patent
Boushek

(10) Patent No.: US 11,511,974 B1
(45) Date of Patent: Nov. 29, 2022

(54) REMOTE CONTROL SYSTEM FOR HOIST

(71) Applicant: Charles Christian Boushek, Otsego, MN (US)

(72) Inventor: Charles Christian Boushek, Otsego, MN (US)

( * ) Notice: Subject to any disclaimer, the term of this patent is extended or adjusted under 35 U.S.C. 154(b) by 17 days.

(21) Appl. No.: 17/366,967

(22) Filed: Jul. 2, 2021

(51) Int. Cl.
*B66C 13/44* (2006.01)
*B66C 13/22* (2006.01)
*B66C 13/40* (2006.01)

(52) U.S. Cl.
CPC ..... *B66C 13/44* (2013.01); *B66C 13/22* (2013.01); *B66C 13/40* (2013.01); *B66C 2700/08* (2013.01)

(58) Field of Classification Search
CPC ..... B66C 13/22; B66C 13/44; B66C 2700/08; B66C 2700/088; B66C 13/40
See application file for complete search history.

(56) References Cited

U.S. PATENT DOCUMENTS 3,463,327 A * 8/1969 Lester ..... G08C 19/12 318/16
2002/0189435 A1* 12/2002 Domann ..... E02F 9/2275 91/459
2003/0164349 A1* 9/2003 Kohlenberg ..... B66C 13/40 212/284
2004/0007443 A1* 1/2004 Munzebrock ..... B66C 13/40 198/678.1
2013/0251498 A1* 9/2013 Dahlen ..... B66C 13/40 212/270

FOREIGN PATENT DOCUMENTS

DE 10357972 A1 * 7/2005 ..... B66C 13/40

OTHER PUBLICATIONS

DE 10357972 A1 Machine Translation. (Year: 2005).*

* cited by examiner

*Primary Examiner* — Michael R Mansen
*Assistant Examiner* — Juan J Campos, Jr.
(74) *Attorney, Agent, or Firm* — Johnson & Phung; Thomas N. Phung

(57) ABSTRACT

A hoists remote-control assembly having an electrical hoist assembly with a combined control signal and electrical input port, a hoist trolley assembly having a control input port and a combined control signal and electrical cable having a free end extending from the hoist trolley assembly with the free end of the control signal and electrical cable removably attachable to the power input port of the hoist assembly, a wireless signal receiver module having a control signal cable removably attachable to the control signal input port of the hoist trolley assembly, a power input port removably attachable to the control signal and electrical cable of the hoist trolley assembly, and a combined control signal and electrical cable removably attachable to the power input port of the hoist assembly, and a wireless transmitter sending wireless operator hoist commands to the wireless signal receiver module located distal to the wireless transmitter.

15 Claims, 3 Drawing Sheets

REMOTE CONTROL SYSTEM FOR HOIST

FIELD OF THE INVENTION

This invention relates generally to hoists and, more specifically to a non-original equipment manufacturer remote hoists control system.

CROSS REFERENCE TO RELATED APPLICATIONS

None

STATEMENT REGARDING FEDERALLY SPONSORED RESEARCH OR DEVELOPMENT

None

REFERENCE TO A MICROFICHE APPENDIX

None

BACKGROUND OF THE INVENTION

Electric hoisting equipment are well known in the art and function to lift and lower payloads in various settings including but not limits to factories, construction sites, and assembly lines. Referring to the drawings, FIG. 1 is a diagram view showing the general components of a standard hoist system 10 for the lifting and lowering of a payload. Hoist system 10 generally includes an electrical-powered hoist assembly 11 for lifting and lowering a payload secured to a chain and hook 12 and a hoist trolley assembly 13 for supporting and powering the hoist assembly 11. FIG. 1 shows the hoist trolley assembly 13 having a wheeled mechanism 15 from which the electrical-powered hoist assembly 11 is suspended from.

The electrical-powered hoist assembly 11 generally includes a combined control signal and electrical power input port 11*a* and the hoist trolley assembly 13 includes a control signal input port 13*a* and a combined control signal and electrical power cable 13*b* having a free end preferably containing a factory connection plug 13*c* extending from the hoist trolley assembly 13 with the connection plug 13*c* of the combined control signal and electrical power cable 13*b* removably attachable to the power input port 11*a* of the hoist assembly 11 without the aid of a tool.

It is noted that although the voltages for powering the hoist system 10 may vary in alternative embodiments of the present invention, in the present embodiment shown in FIG. 1 the electrical power input port combined control signal and electrical power input port 11*a* and the combined control signal and electrical power cable 13*b* are unrelated to the electrical cord or plug that function to power either the electrical-powered hoist assembly 11 or the hoist trolley assembly 13. That is, the electrical cord or plug that typically function to power the electrical-powered hoist assembly 11 and the hoist trolley assembly 13 generally comprises a 230 or 480 volt 3-phrase system or the like whereas the electrical power input port combined control signal and electrical power input port 11*a* and the combined control signal and electrical power cable 13*b* typically supports 110V or the like devices and applications.

Hoist system 10 is also shown having a factory wired pendant controller 14 that includes a control signal cable 14*a* extending from the wired pendant controller 14 with the control signal cable 14*a* having a free end preferably containing a connection plug 14*b* removably attachable to the control signal input port 13*a* of the hoist trolley assembly 13 without the aid of a tool. Wired pendant controller 14 functions to provide operator instructions for the lifting and lowering of a payload by the hoist system 10.

Although hoist systems having wired pendant controllers work for their intended purpose, one of their main short comings is that the wired pendant controllers require that the operator be located in a vicinity within the stretch of the wired pendant controllers.

There thus is a need for a device that can easily convert a new or existing hoist system having a factory wired pendant controller to a hoist system having a hoist wireless control system by simply replacing the factory wired pendant controller with the components of the hoist wireless control system without the use of tools or requiring any modification to the hoist thereby possibly voiding any existing manufactures warranty and may further be accomplished without the aid of any type of tools.

SUMMARY OF THE INVENTION

Briefly, the present invention comprises a hoists remote-control assembly having an electrical-powered hoist assembly, a hoist trolley assembly, a wireless signal receiver module, and a wireless transmitter. The electrical-powered hoist assembly functions to lift and lower a payload with the hoist assembly including a combined control signal and electrical power input port.

The hoist trolley assembly functions to support and power the hoist assembly and includes a control input port and a combined control signal and electrical power cable having a free end extending from the hoist trolley assembly with the free end of the combined control signal and electrical power cable removably attachable to the power input port of the hoist assembly without the aid of a tool.

The wireless signal receiver module functions to receive and process wireless operator hoist commands to control the movement of the hoist assembly with the wireless signal receiver module having a control signal cable with a free end removably attachable to the control signal input port of the hoist trolley assembly without the aid of a tool and without modification to the hoist trolley assembly.

The wireless signal receiver module also includes a power input port removably attachable to the free end of the combined control signal and electrical power cable of the hoist trolley assembly without the aid of a tool, and a combined control signal and electrical power cable having a free end removably attachable to the power input port of the hoist assembly without the aid of a tool and without modification to the hoist assembly. The wireless signal receiver module may also include a power source module having an accessory device power output port.

The wireless transmitter functions to send wireless operator hoist commands to the wireless signal receiver module located distal to the wireless transmitter with the wireless operator hoist commands being in the form of an infrared, Bluetooth™, Wi-Fi, or radio frequency-based signal.

DESCRIPTION OF THE PREFERRED EMBODIMENT

Figure 1:
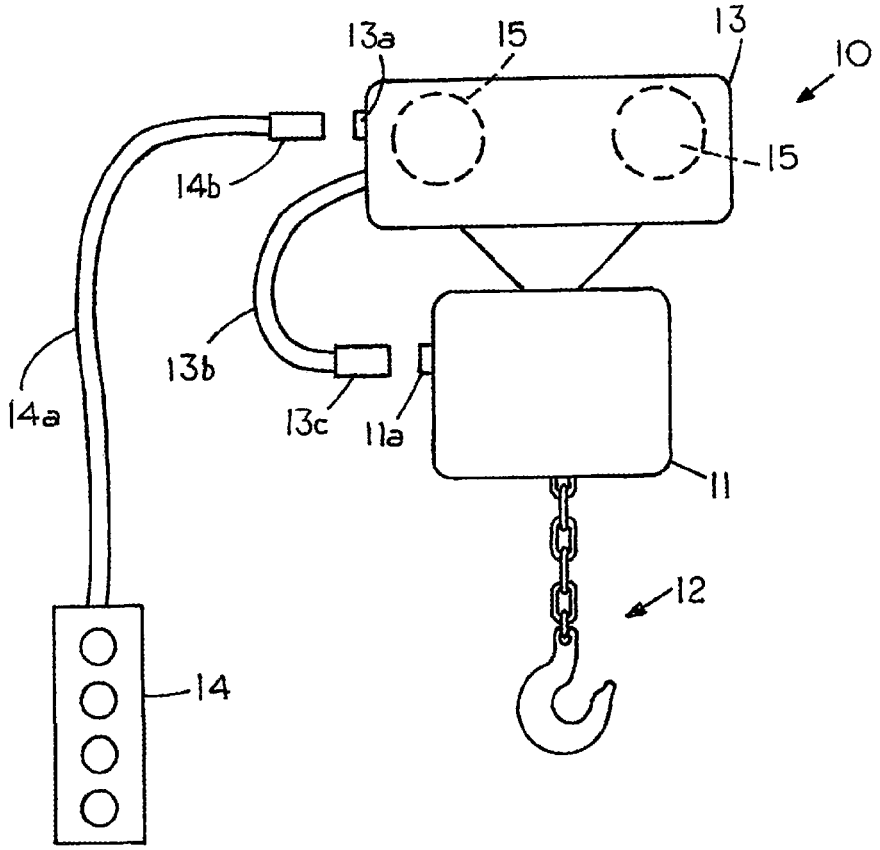
FIG. 1 is a diagram view showing the general components of a standard hoist system for the lifting and lowering of a payload.

The general purpose of the present invention, which will be described subsequently in greater detail, is to provide a non-OEM (original equipment manufacturer) remote control system such as a radio control system that may be installed to a new or used hoists without requiring any modification to the hoist. The aforementioned is accomplished by tapping into an existing connection plug set which carries the additional wires necessary to complete the wiring circuitry.

There has thus been outlined the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the disclosing subject matter be regarded as including such equivalent constructions insofar as they do not depart from the spirit and scope of the present invention.

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

In addition, the accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of any potential claims.

Figure 2:
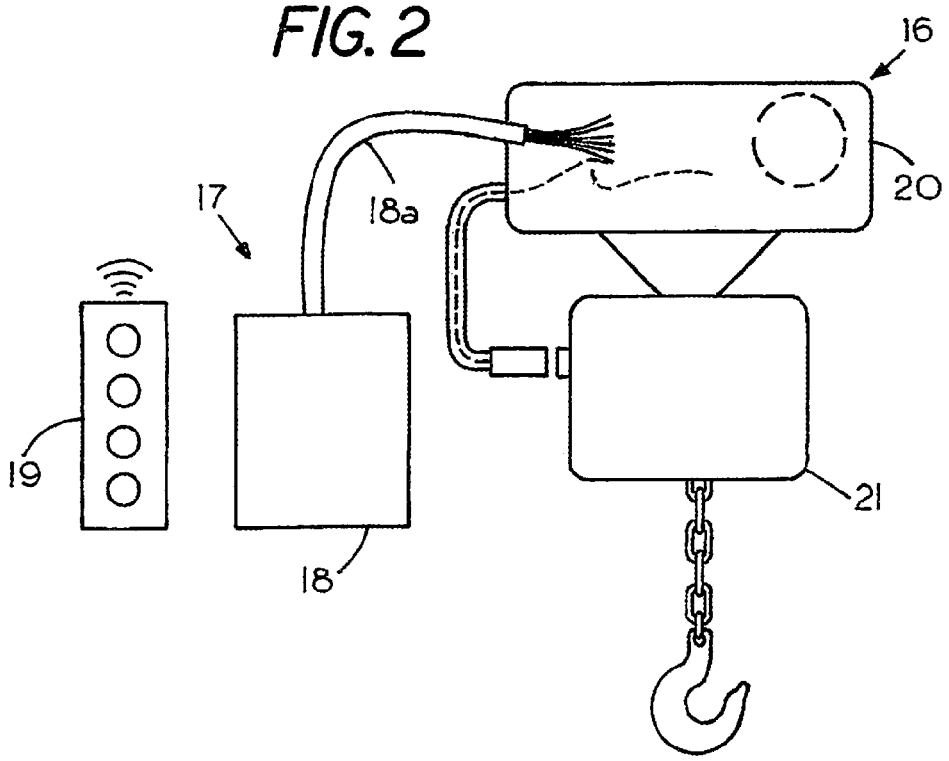
FIG. 2 is a diagram view showing a hoist system incorporating a remote-control system providing operator instructions for the lifting and lowering of a payload by the hoist system.

FIG. 2 is a diagram view showing the general components of a hoist system 16 having similar components to the hoist system 10 of FIG. 1. However, instead of having a factory wired pendant controller 14, hoist system 16 is shown incorporating a remote-control system 17 to provide operator instructions for the lifting and lowering of a payload by the hoist system 16. The remote-control system 17 is not an original equipment manufacturer (OEM) product and typically is installed to the hoist system 16 by a third party who has to open the housing of the hoist system 16 to permanently hardwire the remote-control system 17 to a component located within a housing of the hoist system 16. In addition to the installation cost of the third party install, the physical modification to either the electrical-powered hoist assembly 11 or the hoist trolley assembly 13 which may have the undesired result of possibly voiding any existing manufactures warranty to the electrical-powered hoist assembly 11 or the hoist trolley assembly 13.

The remote-control system 17 generally includes a radio receiver 18 and a wireless transmitter 19. The radio receiver 18 is shown permanently connected to an interworking component (not shown) of the hoist trolley assembly 20 by a control signal cable 18*a*. For example, a free end of the control signal cable 18*a* may be secured to a control circuit board located within the housing of the hoist trolley assembly 20 by wire nuts or similar means. The wireless transmitter 19 functions to send the wireless operator instructions to the radio receiver 18, which receives and forwards the operator instructions to the hoist trolley assembly 20 with the hoist trolley assembly 20 eventually is sent to an electrical-powered hoist assembly 21 for the lifting and lowering of a payload by the hoist system 21.

Figure 3:
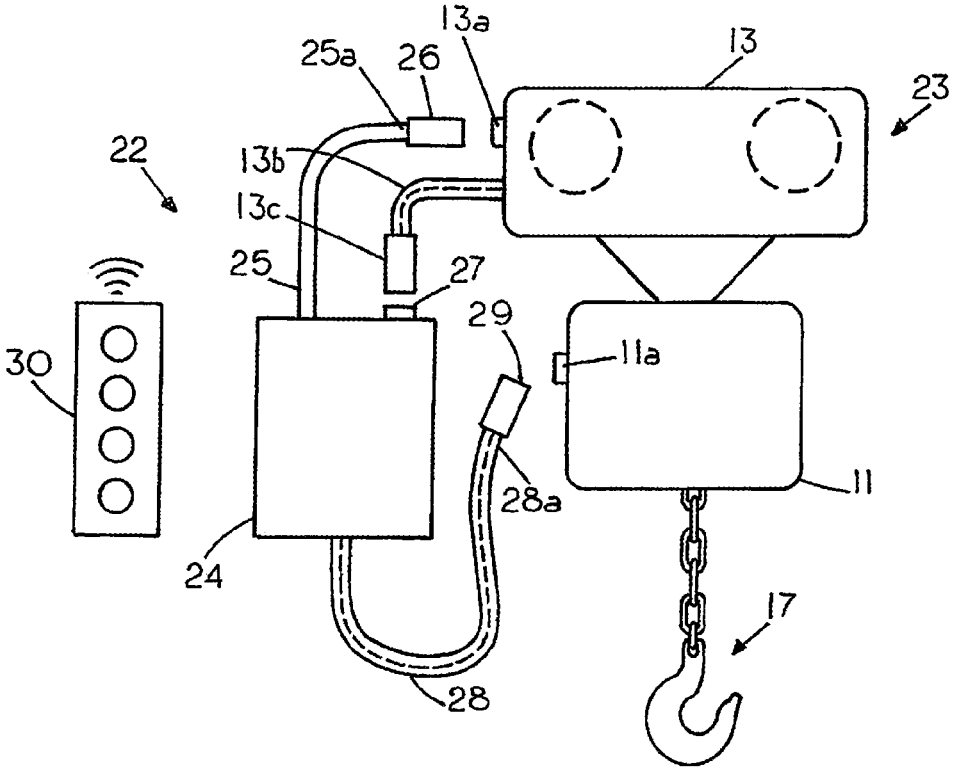
FIG. 3 is a diagram view showing a hoist system having a hoists remote-control assembly of the present invention.

FIG. 3 is a diagram view showing an embodiment of a hoists remote-control assembly 22 of the present invention that allows an end operator to easily converts a hoist system having a factory wired pendant controller such as the hoist system 10 of FIG. 1 to a hoist system 23 having a remote-control system by simply replacing the factory wired pendant controller 14 of hoist system 10 with the components of the hoists remote-control assembly 22. A feature of the present invention is that the aforementioned may be accomplished without opening the housing of either the electrical-powered hoist assembly 11 or the hoist trolley assembly 13 which may void any existing manufactures warranty and may further be accomplished without the aid of any types of tools. Although the hoists remote-control assembly 22 may be provided as an OEM product, the hoists remote-control assembly 22 is preferably provided as an after-market kit to allow for the conversion of not only new but used hoist systems having a factory wired pendant controller to a hoist system having a remote-control system.

As shown in FIG. 3 the hoists remote-control assembly 22 generally includes a wireless transmitter 30 for sending wireless operator hoist commands and a wireless signal receiver module 24 for receiving and processing the wireless operator hoist commands to control the movement of the hoist assembly 11 and more specifically, the movement of the chain and hook 12 with respect to the hoist assembly 11. It is noted that wireless transmitter 30 may comprise various types devices capable of transmitting a signal to the wireless signal receiver module 24 including but not limits to a standardized handheld remote, smartphones, and various types of portable devices including but not tablets and laptops, and chrome books.

Although the wireless signal receiver module 24 and the wireless transmitter 30 may communicate through a variety of wireless means including but not limited to infrared, Bluetooth™, and Wi-Fi based signal, due to the distance and stability of their signals, the wireless signal receiver module 24 and the wireless transmitter 30 preferably communicate through a radio frequency.

The wireless signal receiver module 24 includes a control signal cable 25 having a free end 25*a* with a connection plug 26 removably attachable to the control signal input port 13*a* of the hoist trolley assembly 13 without the aid of a tool and without opening the housing of the hoist trolley assembly 13 and without modification to the hoist trolley assembly 13.

The wireless signal receiver module 24 also includes a power input port 27 removably attachable to the connection plug 13*c* of the combined control signal and electrical power cable 13*b* of the hoist trolley assembly 13 without the aid of a tool. The wireless signal receiver module 24 further includes a combined control signal and electrical power cable 28 having a free end 28*a* with a connection plug 29 removably attachable to the power input port 11*a* of the hoist assembly 11 without the aid of a tool and without modification to the hoist assembly 11.

In use, although the wireless signal receiver module 24 may be left hanging from the hoist assembly 11 and the hoist trolley assembly 13 via control signal cable 25 and combined control signal and electrical power cable 28, in order to help support the connection of the wireless signal receiver module 24 to the hoist assembly 11 and the hoist trolley assembly 13 the wireless signal receiver module 24 is preferably mounted to either the hoist assembly or the hoist trolley assembly 13 in some fashion such as through the use of an adhesive or various types of securement devices including but not limited to ropes, a hook and loop securement device (Velcro™), and cable ties without physical modification to the hoist assembly 11 or the hoist trolley assembly 13. For example, the wireless signal receiver module 24 may be mounted to the hoist assembly 11 using factory holes and hardware located on the hoist assembly 11.

Figure 3A:
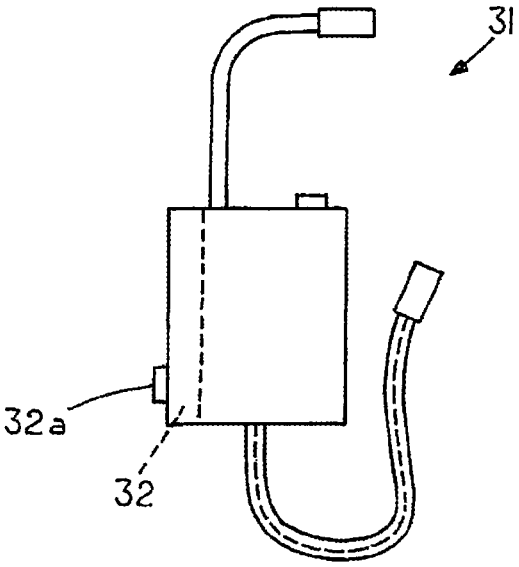
FIG. 3A is a diagram view showing a wireless signal receiver module that includes a power source module for powering various accessory.

FIG. 3A is a diagram view showing an alternative embodiment of a wireless signal receiver module 31 having similar components to the wireless signal receiver module 24 of FIG. 3. However, wireless signal receiver module 31 also includes a power source module 32 for powering various accessory devices that may be desirable for use proximal a hoist system including but not limited to lights, sensors, control equipment such as programmable logic controller (PLC) and relays, and displays. As shown in FIG. 3A, the power source module 32 includes an accessory device power output port 32*a* for preferably tool-less connection to the accessory device. Although the wireless signal receiver module 31 and power source module 32 is shown as comprising a one-piece unit, alternative embodiment of the present invention may comprise the radio receiver module and the power source module as separate units.

Figure 4:
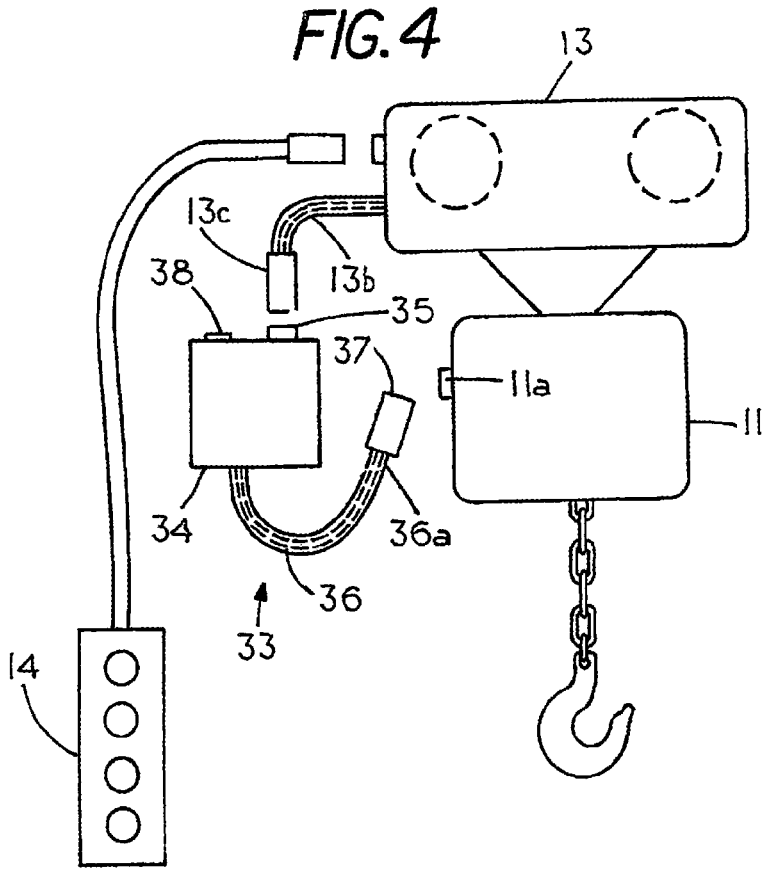
FIG. 4 is a diagram view showing a hoists control system that allows an end operator to easily add an after-market power source module to the hoist system of FIG. 1.

FIG. 4 is a diagram view showing an alternative embodiment of the present invention comprising a hoists control system 33 that allows an end operator to easily add an after-market power source module 34 to the hoist system 10 of FIG. 1 for powering various accessory devices that may be desirable for use proximal a hoist system including but not limited to lights, sensors, control equipment such as programmable logic controller (PLC) and relays, and displays. Similar to the wireless signal receiver module 31 of FIG. 3A, the power source module 34 includes a combined control signal and electrical power input port 35 removably attachable to the connection plug 13*c* of the combined control signal and electrical power cable 13*b* of the hoist trolley assembly 13 without the aid of a tool.

The power source module 34 also includes a combined control signal and electrical power cable 36 having a free end 36*a* with a connection plug 37 removably attachable to the power input port 11*a* of the hoist assembly 11 without the aid of a tool and without modification to the hoist assembly 11. The power source module 34 further includes an accessory device power output port 38 for preferably tool-less connection to various accessory devices that may be desirable for use proximal a hoist system for providing power to those accessory devices. A feature of the present invention is that the aforementioned may be accomplished without opening the housing of either the electrical-powered hoist assembly 11 or the hoist trolley assembly 13 which again may negate any pending manufactures warranty.

I claim:

1. A hoists remote-control assembly comprising:

an electrical-powered hoist assembly for lifting and lowering a payload, the hoist assembly having a combined control signal and electrical power input port;

a hoist trolley assembly for supporting and powering the hoist assembly, the hoist trolley assembly having a control input port and a combined control signal and electrical power cable having a free end extending from the hoist trolley assembly with the free end of the combined control signal and electrical power cable removably attachable to the power input port of the hoist assembly without the aid of a tool;

a wireless signal receiver module for receiving and processing wireless operator hoist commands to control the movement of the hoist assembly, the wireless signal receiver module having a control signal cable with a free end removably attachable to the control input port of the hoist trolley assembly without the aid of a tool and without modification to the hoist trolley assembly, a power input port removably attachable to the free end of the combined control signal and electrical power cable of the hoist trolley assembly without the aid of a tool, and a combined control signal and electrical power cable having a free end removably attachable to the power input port of the hoist assembly without the aid of a tool and without modification to the hoist assembly; and a wireless transmitter for sending wireless operator hoist commands to the wireless signal receiver module located distal to the wireless transmitter.

2. The hoists remote-control assembly of claim 1 wherein the free end of the combined control signal and electrical power cable of the hoist trolley assembly, the free end of control signal cable of the wireless signal receiver module, and the free end of the combined control signal and electrical power cable of the wireless signal receiver module includes each includes a connection plug.

3. The hoists remote-control assembly of claim 2, wherein the connection plugs of the wireless signal receiver module and the hoist trolley assembly comprise factory connection plugs.

4. The hoists remote-control assembly of claim 1 wherein the wireless signal receiver module includes a power source module having an accessory device power output port.

5. The hoists remote-control assembly of claim 1 wherein the wireless signal receiver module is mounted to the hoist assembly using factory holes and hardware located on the hoist assembly.

6. The hoists remote-control assembly of claim 1 wherein the wireless signal receiver module is mounted to either the hoist assembly or the hoist trolley assembly without physical modification to the hoist assembly or the hoist trolley assembly.

7. The hoists remote-control assembly of claim 1 wherein the wireless signal receiver module and the wireless transmitter communicates through a radio frequency.

8. The hoists remote-control assembly of claim 1 wherein the wireless signal receiver module and the wireless transmitter communicates through an infrared, Bluetooth or Wi-Fi based signal.

9. A hoists remote-control assembly comprising:

an electrical-powered hoist assembly for lifting and lowering a payload, the hoist assembly having a combined control signal and electrical power input port;

a hoist trolley assembly for supporting and powering the hoist assembly, the hoist trolley assembly having a control input port and a combined control signal and electrical power cable having a free end extending from the hoist trolley assembly with the free end of the combined control signal and electrical power cable removably attachable to the power input port of the hoist assembly without the aid of a tool;

a combined radio receiver and power source module for controlling the movement of the hoist assembly while simultaneously providing power to accessory devices, the combined radio receiver and power source module having a control signal cable with a free end removably attachable to the control signal input port of the hoist trolley assembly without the aid of a tool, a power input port removably attachable to the free end of the combined control signal and electrical power cable of the hoist trolley assembly without the aid of a tool, an accessory device power output port, and a combined control signal and electrical power cable having a free end removably attachable to the power input port of the hoist assembly without the aid of a tool; and a wireless transmitter for sending wireless operator hoist control instructions to the combined radio receiver and power source module.

10. The hoists remote-control assembly of claim 9 wherein the combined radio receiver and power source module is mounted to the hoist assembly using factory holes and hardware.

11. The hoists remote-control assembly of claim 10 wherein the free end of the combined control signal and electrical power cable of the hoist trolley assembly, the free end of control signal cable of the combined radio receiver and power source module, and the free end of the combined control signal and electrical power cable of the combined radio receiver and power source module includes each includes a connection plug.

12. A hoists control system comprising:

an electrical-powered hoist assembly for lifting and lowering a payload, the hoist assembly having a combined control signal and electrical power input port;

a wired pendant switch assembly for controlling the hoist assembly, the wired pendant switch assembly having a control signal cable with a free end removably attachable to the control signal input port of the hoist trolley assembly without the aid of a tool;

a hoist trolley assembly for supporting and powering the hoist assembly, the hoist trolley assembly having a control input port and a combined control signal and electrical power cable having a free end; and a power source module having a combined control signal and electrical power input port removably attachable to the free end of the combined control signal and electrical power cable of the hoist trolley assembly without the aid of a tool, an accessory device power output port, and a combined control signal and electrical power cable having a free end removably attachable to the combined control signal and electrical power input port of the hoist assembly without the aid of a tool.

13. The hoists control system of claim 12 wherein the free end of the combined control signal and electrical power cable of the hoist trolley assembly, the free end of control signal cable of the wired pendant switch assembly, and the free end of the combined control signal and electrical power cable of the power source module includes each includes a connection plug.

14. The hoists control system of claim 12 wherein the power source module is mounted to the hoist assembly using factory holes and hardware.

15. The control system of claim 12 wherein the power source module is mounted to the hoist assembly without physical modification to the hoist assembly.

* * * * *